US006250377B1

(12) United States Patent
Gyenese, Jr.

(10) Patent No.: US 6,250,377 B1
(45) Date of Patent: Jun. 26, 2001

(54) ENGINE RADIATOR HAVING AN AIR CONTROL HOOD

(75) Inventor: Albert W. Gyenese, Jr., Sterling Heights, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/472,305

(22) Filed: Dec. 27, 1999

(51) Int. Cl.[7] ..... F28D 15/00

(52) U.S. Cl. ..... 165/104.32; 165/110; 165/917; 123/41.54

(58) Field of Search ..... 165/110, 104.32, 165/917; 123/41.54

(56) References Cited

U.S. PATENT DOCUMENTS 2,235,806 * 3/1941 Walker et al. ..... 165/104.32 X
3,254,707 * 6/1966 Ferguson ..... 165/104.32 X
3,989,103 * 11/1976 Cieszto et al. ..... 165/917 X
4,491,174 * 1/1985 Villoval ..... 165/104.32
4,781,247 * 11/1988 Schulz ..... 165/104.32
5,044,430 * 9/1991 Avrea ..... 165/104.32

FOREIGN PATENT DOCUMENTS

0075750 * 1/1983 (EP) ..... 165/917
1286713 * 1/1962 (FR) ..... 165/917
1191609 * 1/1985 (SU) ..... 165/104.32

* cited by examiner

*Primary Examiner*—Christopher Atkinson
(74) *Attorney, Agent, or Firm*—Bill C. Panagos

(57) ABSTRACT

An engine radiator of the coolant downflow type can be equipped with an internal hood structure at the mouth of the radiator exit flow passage, to prevent air entrainment with the downflowing coolant.

3 Claims, 1 Drawing Sheet

ENGINE RADIATOR HAVING AN AIR CONTROL HOOD

BACKGROUND AND SUMMARY OF THE INVENTION

This invention relates to engine radiators, and particularly to a radiator having an integral top tank overlying the radiator coolant exit passage, whereby a barrier is provided against downflow of air into said exit passage. The invention prevents, or minimizes undesired air flow into the coolant pump, which may result in cavitation failures.

Some engine radiators of the downflow type have plural finned heat exchanged tubes (or passages.) extending between an upper tank and a lower tank. The lower tank has a coolant exit passage extending downwardly from the tank bottom wall for conveying coolant to a coolant pump mounted on the engine.

It has been found that during the engine operation air in the upper tank of the radiator can be pulled downwardly through those heat exchange tubes that are in direct vertical alignment with the coolant exit passage. Coolant pump suction draws this air from the radiator coolant exit passage through the lower radiator hose into the pump and forces it through the engine. Such airflow is disadvantageous in that it can degrade the cooling system and result in liner cavitation. Also, such air can form a vapor lock in the coolant circulation system so as to reduce coolant flow. In some cases small air bubbles can be formed in the coolant, thereby reducing the heat-absorption properties of the coolant; the coolant assumes a dark brown appearance having a reduced capability for extracting heat from the contacted engine surfaces.

The present invention contemplates the employment of a small hood in the lower tank of the radiator for blocking downward airflow into the coolant exit passage, especially during the engine start-up period. The hood is designed to overlie the coolant exit passages as to obstruct air from re-entering the cooling system via the fill line.

Specific features of the invention will be apparent from the attached drawings and description of an illustrative embodiment of the invention.

DESCRIPTION OF A PREFERRED EMBODIMENT OF THE INVENTION

Figure 1:
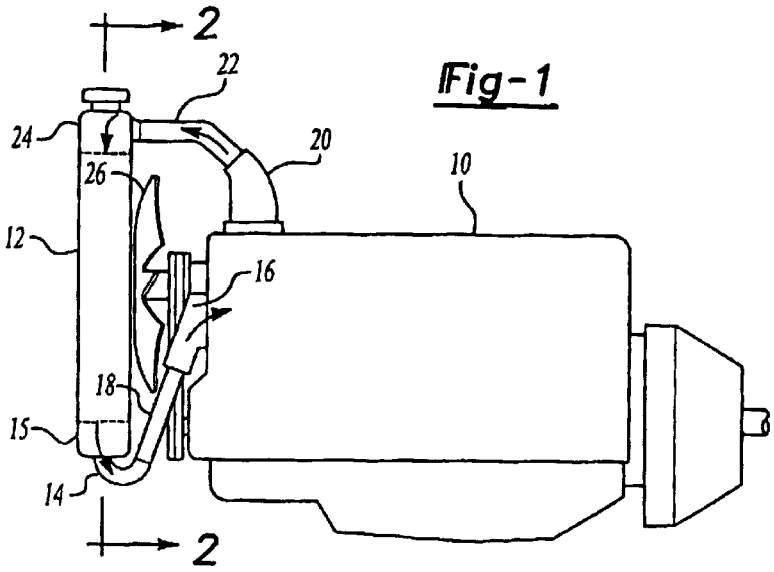
FIG. 1 is a side elevational view of an engine equipped with a radiator constructed according to the invention.

Referring to FIG. 1, there is shown a cooling system for an internal combustion engine 10. The engine can be a diesel engine or a gasline engine of conventional construction.

The engine cooling system includes an upstanding radiator 12 having a liquid coolant exit passage 14 extending from a lower tank 15, a coolant pump 16 mounted on the engine, and a lower radiator hose 18 connecting exit passage 14 to the pump inlet.

Pump 16 delivers dilute liquid anti-freeze (coolant) into coolant passages in the engine. The heated coolant exits the engine through a bell-shaped housing 20 that contains a thermostat of known construction. Liquid coolant passes upwardly through housing 20 into an upper radiator hose 22 that communicates with the top tank 24 of the radiator. Plural finned heat exchange tubes return the coolant from upper tank 24 to lower tank 15. Coolant pump 16 provides the pump force for circulating the liquid coolant through the engine and radiator.

Coolant flowing downwardly through the finned heat exchange tubes in radiator 12 is cooled by a fan 26 that may be driven by the engine or by a small electric motor (not shown).

Figure 2:
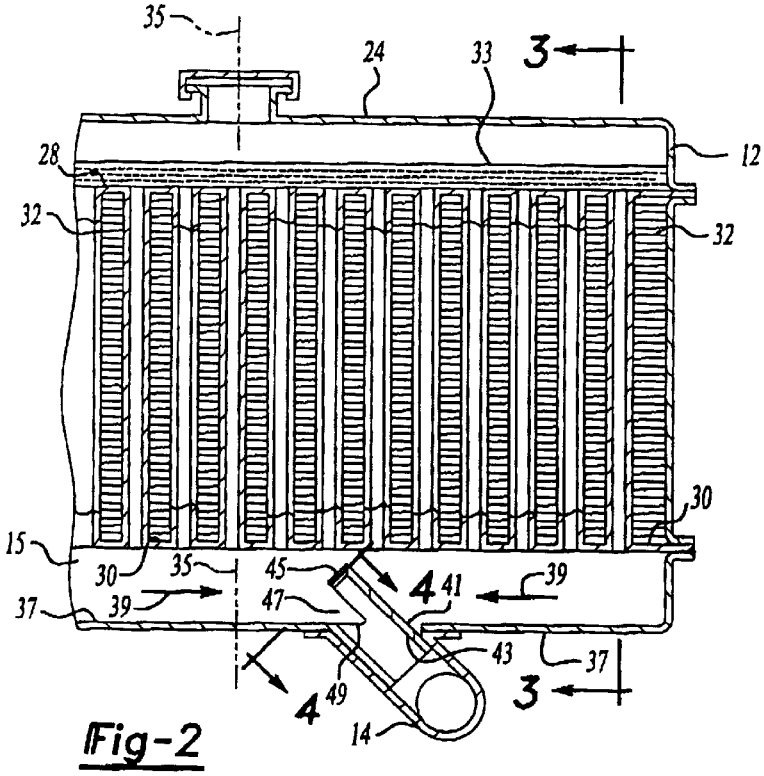
FIG. 2 is a fragmentary sectional view taken on line 2—2 in FIG. 1.

The invention relates to the radiator 12, and more particularly to a mechanism within the radiator for preventing air flow downwardly through the radiator heat exchange passages during the engine operation. As shown in FIG. 2, the radiator includes an upper tank 24 having an upper tube sheet 28, and a lower tank 15 having a lower tube sheet 30. Finned heat exchange tubes 32 extend between the tube sheets for conducting the liquid coolant downwardly from tank 24 into tank 15. The normal liquid level in tank 24 is referenced by numeral 33.

Air in the tank space above liquid level 33 is necessary to allow for thermal expansion of liquid coolant. Tank 24 is usually the highest point in the coolant circulation system, so that the, air accumulates in tank 24, rather than in other points in the system where the air could interfere with normal coolant flow.

During normal circulation of the liquid coolant, some liquid preferably flows downwardly through each of the finned heat exchange passages 32, so that the coolant in tank 15 is at a suitable temperature. In order to promote liquid flow through each heat exchange tube 32, coolant exit passage 14 is offset laterally from the radiator central vertical axis 35; also, exit passage 14 is acutely angled to central axis 35 at an angle approximating forty five degrees.

Exit passage 14 is a cylindrical tubular passage extending angularly downwardly from bottom wall 37 of lower tank 15 so that liquid moves along tank 15 in opposite directions in order to reach tubular passage 14, as denoted by arrows 39 in FIG. 2. The offsetting of exit passage 14 from radiator central axis 35, in combination with the forty five degree angulation of passage 14, enables coolant to be drawn from both ends of tank 15, whereby the coolant is distributed in a reasonably even fashion through all of the heat exchange tubes 32.

One problem with the illustrated passage 14 arrangement is that the pump suction force is directed through passage 14. The air entrainment phenomena is a problem because when the air gets into pump 16 and the engine coolant passages, the air can produce pitted liners, as well as other undesired conditions. To prevent the disadvantageous air entertainment action, there is provided a hood 41 in the entrance mouth of tubular exit passage 14.

Within the broad scope of the invention, hood 41 can take various forms. As shown in the drawings, the hood comprises a cylindrical tubular side wall 43 telescoped into the cylindrical passage 14, so that only the lower portion of cylindrical wall 43 is below the plane of tank bottom wall 37. The upper portion of hood 41 is located within tank 15.

Hood 41 has a top wall 45 that blocks direct downflow of coolant (or air) from the top tank 24 in direct vertical alignment with the entrance mouth of passage 14. Fluid flow into hood 41 takes place through a single flow opening 47 formed partly in hood side wall 43 and partly in hood top wall 45.

Figure 4:
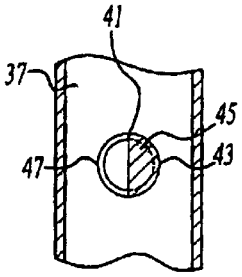
FIG. 4 is a fragmentary sectional view taken on line 4—4 in FIG. 2.

As shown in FIG. 4, flow opening 47 occupies approximately one half the circumferential dimension of tubular side wall 42. The semi-circular opening 47 faces the radiator central axis 35, so that coolant flow into hood 41 takes place from the tank space to the left of hood 41 and also from the two spaces alongside the flow opening 47.

Figure 3:
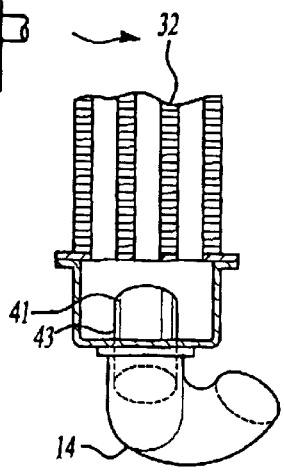
FIG. 3 is a fragmentary sectional view taken on line 3—3 in FIG. 2.

The flow opening has a lower edge 49 that is in the plane of tank bottom wall 37, whereby coolant can freely flow along the tank bottom wall into the hood without encountering any obstructions. Coolant flowing leftwardly from the right end of tank 15 (as viewed in FIG. 2) can move around the round exterior surfaces of the hood side wall 43 without undue difficulty, due to the fact that flow spaces are provided along the sides of the hood, as shown in FIG. 3. Leftwardly flowing coolant can move into the hood from both side surfaces of the hood at the circumferential limits of flow opening 47.

As shown in FIG. 4, top wall 45 of the hood has a semi-circular configuration. Approximately one half the wall circular outline is cut away to help form the flow opening 47. The flow opening is of sufficient size to accommodate the entire flow from the array of heat exchange tubes 32. Any pressure drop across flow opening 47 can be of some advantage in helping to provide a more uniform flow distribution across heat exchange tubes 32. Top wall 45 of the hood helps to block direct downflow of fluid from those heat exchange tubes 32 in direct vertical alignment with the entrance mouth of tubular passage 14. The initial suction force is directed laterally within tank 15, rather than vertically into tubes 32 above hood 41.

As previously noted, hood 41 overlies passage 14 whereby air in the top tank 24 is prevented from having a linear path through into passage 14. This precludes air entrainment into the circulating coolant during engine operation when the pump suction force would tend to be momentarily concentrated in the tube 32 area directly above the upper mouth of passage 14.

Hood 41 is a relatively low cost component that serves an important anti-air entrainment function in the engine coolant circulation system. The hood can be formed by various manufacturing procedures, e.g. machining solid bar stock, or fabricating from a stamping and tube stock.

The drawings necessarily show a particular hood configuration. However, it will be appreciated that different hood configurations can be employed in practice of the invention.

What is claimed:

1. A radiator for an engine comprising:

the radiator shell that includes an upper coolant tank, a lower coolant tank, and plural finned heat exchanged tubes extending from the upper tank to the lower tank; said radiator having a central vertical axis; said lower tank comprising a bottom wall and two upstanding side walls; a coolant exit passage means extending angularly downwardly from said tank bottom wall at an acute angle to said central vertical axis; said exit passage means being offset an appreciable distance from the radiator central axis; and a hood overlying said exit passage means within the lower tank, said hood equipped with a top wall spaced above the tank bottom wall, and a single side opening facing the radiator central axis, whereby air in the upper tank is prevented from having a linear path to said passage means.

2. The radiator of claim 1, wherein said hood has a tubular mounting wall telescoped into said exit passage means.

3. The radiator of claim 1, wherein said exit passage means has a circular cross section, and said hood has a tubular mounting wall telescoped into the circular cross-sectioned passage means.

* * * * *